United States Patent [19]

Fasse

[11] Patent Number: 4,843,672

[45] Date of Patent: Jul. 4, 1989

[54] BOOT OVERSOLE AND CARRIER

[76] Inventor: Walter F. Fasse, P.O. Box K, St. Albans, Me. 04971

[21] Appl. No.: 154,958

[22] Filed: Feb. 10, 1988

[51] Int. Cl.[4] ..... A43D 5/00; A43B 3/16; A43B 5/04

[52] U.S. Cl. ..... 12/120.5; 36/7.5; 36/117; 36/132

[58] Field of Search ..... 36/7.5, 7.6, 7.8, 117, 36/132, 59 R, 59 B, 59 C, 114; 12/120.5

[56] References Cited

U.S. PATENT DOCUMENTS

| | | | |
|---|---|---|---|
| 3,210,787 | 10/1965 | Allsop . | |
| 3,590,410 | 7/1971 | Shields | 12/120.5 |
| 3,665,620 | 5/1972 | St. Clair . | |
| 3,775,875 | 12/1973 | Dvorsky . | |
| 4,160,301 | 7/1979 | Woolley | 12/120.5 |
| 4,199,880 | 4/1980 | Frey | 36/132 |
| 4,228,602 | 10/1980 | Groves . | |
| 4,286,397 | 9/1981 | Booty . | |
| 4,299,037 | 11/1981 | Carey . | |
| 4,351,120 | 9/1982 | Dalebout . | |
| 4,505,057 | 3/1985 | Kiester . | |
| 4,542,599 | 9/1985 | Annovi . | |
| 4,570,363 | 2/1986 | Annovi . | |
| 4,619,059 | 10/1986 | Koniuk | 36/132 |

FOREIGN PATENT DOCUMENTS

| | | | |
|---|---|---|---|
| 238452 | 9/1987 | European Pat. Off. | 36/117 |
| 310459 | 1/1919 | Fed. Rep. of Germany | 36/59 R |
| 3526298 | 1/1987 | Fed. Rep. of Germany | 36/114 |
| 34181 | 7/1905 | Switzerland | 36/7.8 |
| 580927 | 10/1976 | Switzerland | 36/132 |

*Primary Examiner*—James Kee Chi

*Attorney, Agent, or Firm*—W. G. Fasse; D. H. Kane, Jr.

[57] ABSTRACT

A boot oversole and carrier attachment for boots, such as ski boots, provides several advantages. The boot oversole is characterized by a wedged thickness which compensates for the unnatural leg angle imposed by ski boots. A pair of oversoles may be easily attached to ski boots for improved walking and protection of the boot soles, and may be easily removed for normal skiing operation. The tread of the oversole is preferably of dovetail grooves to provide good traction and to allow the oversoles of a mating pair to be easily interlocked. A handle and a storage base are provided on each oversole without interfering with the walking characteristics, for conveniently carrying and storing a pair of boots mounted on the interlocked oversoles.

17 Claims, 4 Drawing Sheets

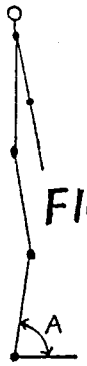
FIG. 2A
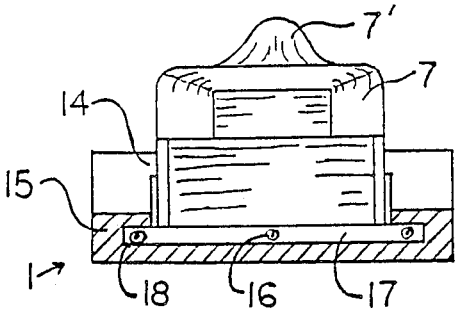
FIG. 3
FIG. 2B
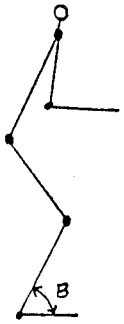
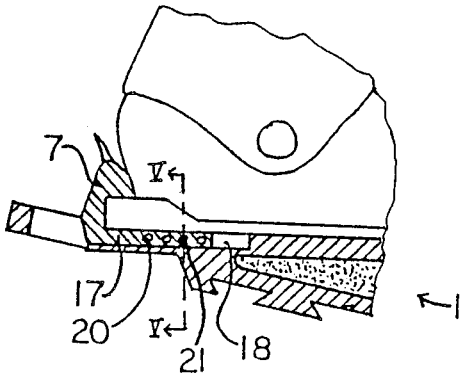
FIG. 4
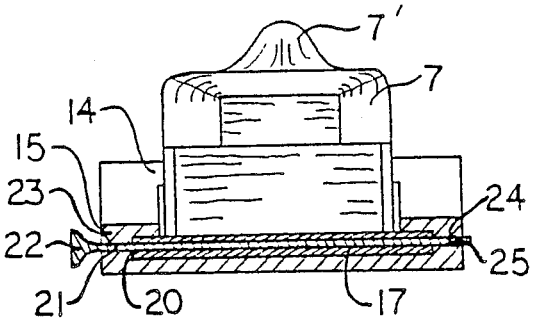
FIG. 5

BOOT OVERSOLE AND CARRIER

FIELD OF THE INVENTION

The present invention relates to a boot oversole and carrying accessory, with special applicability as a ski boot oversole and carrier. The oversole and carrier of the invention provides improved walking traction on snow and ice, improved walking comfort, protection of the boot sole surfaces, and a means for interlocking the boots for convenient storage and carrying.

DESCRIPTION OF THE PRIOR ART

Modern ski boots are plagued by several disadvantages. The boot rigidity and forward rake or lean angle necessary for good skiing make walking in modern ski boots difficult and uncomfortable. Ski boot soles are generally flat and quite smooth, so that they provide little traction for walking on ice and snow. Furthermore, the soles and binding contact surfaces of the boots are subject to substantial wear when the boots are worn for walking even short distances over abrasive surfaces such as parking lots or rough ice. Modern high-precision bindings require precision in the mating contact surfaces of the boots to ensure proper and safe functioning. The boot's contact surfaces may become worn to such an extent that safe and effective mating with the binding is prevented. Lastly, the large, stiff boots are awkward to store and to carry. These or similar disadvantages are also characteristic of other footwear such as mountain climbing boots, ice skates, etc.

Many attempts have been made at avoiding at least some of these disadvantages. U.S. Pat. No. 3,210,787 discloses a boot carrying and storage device with a handle for carrying, and a base for storing, two boots held together in a sole-to-sole orientation through means for engaging the boot soles. The other particular problems associated with boots, as mentioned above, are not addressed.

Oversoles to be attached to boots to improve walking comfort, and in some cases to increase traction, etc., are disclosed in U.S. Pat. Nos. 4,228,602; 4,286,397; and 4,619,059. The accessories disclosed therein variously comprise a rounded and/or resilient base to be worn over the boot sole during walking. These conventional devices aim to improve the walking comfort and reduce traction problems, but do not provide the additional benefits disclosed herein. Attention is also called to a block to be attached to a boot sole as disclosed in U.S. Pat. No. 3,665,620.

U.S. Pat. Nos. 4,542,599 and 4,570,363 describe specialized ski boots having a traction sole, and hardly any forward rake angle of the leg support. A sole accessory is attached during skiing to provide appropriate rake angle and mating with standard bindings. These sole attachments would actually cause the walking disadvantages mentioned above and are therefore not appropriate for attachment to standard ski boots currently available. Furthermore, they may compromise the rigid connection necessary between the boot and the ski binding. U.S. Pat. No. 4,351,120 discloses a boot with replaceable or interchangeable sole surfaces, not directly related to an oversole for walking which is to be removed during skiing. Another specialized sole protector and walking aid is disclosed in U.S. Pat. No. 3,775,875.

A ski boot with a specialized sole adapted for walking comfort is disclosed in U.S. Pat. No. 4,505,057. This ski boot requires a special ski binding to mate with the shape of the boot sole and is not directly related to a boot oversole.

The dual problems of wear of the boot sole and lack of traction are addressed in U.S. Pat. No. 4,299,037, which discloses a flat, relatively thin oversole for boots such as ski boots. This oversole does not correct or counteract the forward rake imposed on a walking skier's leg by the ski boot, nor does it provide means for interlocking, carrying, or storing a pair of boots.

OBJECTS OF THE INVENTION

In view of the foregoing it is the aim of the invention to achieve the following objects singly or in combination, in a boot oversole and carrying accessory particularly suited to use with ski boots:

to provide increased traction for walking on ice and snow;

to achieve improved walking ease and comfort by providing cushioning and/or by at least partially compensating for the forward lean or rake angle imposed on the walking skier's leg by the ski boot;

to protect the sole and binding contact surfaces of a ski boot from wear when the accessory is worn over the sole during walking on rough or abrasive surfaces and to discourage the accumulation of snow or mud on the boot sole;

to provide means for interlocking the oversoles attached to a pair of boots so as to rigidly hold the boots in a sole-to-sole orientation, and further to provide a flat base, so that the boots may be conveniently stored in such an interlocked configuration;

to provide a handle on a pair of interlocked oversoles, so that a pair of boots may be conveniently carried in an interlocked configuration;

to provide increased support for walking in deep snow while wearing the accessory over ski boots in the manner of a snowshoe;

to provide increased traction for climbing steep grades, in the manner of an ice-climbing boot;

to allow such an oversole to be easily attached to and detached from standard ski boot soles ranging over several shoe sizes; and to achieve these objects in an accessory of simple and inexpensive construction.

SUMMARY OF THE INVENTION

The above objects have been achieved in the boot oversole and carrier of the invention as disclosed herein. The boot oversole is generally useful as an accessory for many types of boots and shoes and is construed to pertain to these broad applications, but will be described specifically as an accessory for ski boots.

The ski boot oversole and carrier of the invention has an essentially flat sole contact surface having a length and width substantially the same as the ski boot sole to which it is attached. The front and rear ends of the sole contact surface are bounded by a toe engagement flange and a heel engagement flange, respectively. These flanges are constructed to mate with the standard sized toe and heel binding contact lips of ski boots.

The ground contact surface or tread of the oversole extends at a small angle, generally five to fifteen degrees, relative to the sole contact surface, and has substantially the same width, but a shorter length than the sole contact surface. This angled arrangement provides for a wedge between the two surfaces which becomes thicker toward the front or toe end of the accessory. This wedge may be of a resilient material or may even enclose a hollow air cavity. The angle of the wedge, in combination with the shortened ground contact surface and resilient cushioning, improve the walking ease and comfort.

The length of the oversole is adjustable to fit several sizes of boot soles through the provision of narrowed elastic bands, or spring loaded rails connecting a front member and a rear member of the oversole, or through the provision of adjustment means, such as spring loaded rails, for either the toe or heel engagement flanges.

The ground contact surface comprises a coarse, open tread profile for good traction on ice and snow with reduced plugging by snow. Preferably, the tread comprises dovetailtype transverse grooves or blocks. The treads of a mating pair of oversoles are mirror-images of each other so that the pair of soles may be interlocked by engaging the respective mating dovetail treads.

Interlocking of paired oversoles may alternatively be achieved by providing appropriate locking bails, rotatable cam hook latches, interlocking rods or alternative interlocking treads, for example.

A flat storage base is provided at the front end of the oversole and extends essentially perpendicularly to the ground contact surface. A handle or carrying loop is provided at the rear end of the oversole, and extends essentially in parallel to the ground contact surface. The storage base and carrying handle are sufficiently out of the plane of the ground contact surface so that they do not interfere with normal walking, but may provide additional traction or support when walking in deep snow or climbing steep grades by "chiseling" the frontmost portion of the oversole into the inclined surface on which a person wants to walk.

BRIEF DESCRIPTION OF THE DRAWINGS

In order that the invention may be clearly understood, it will now be described, by way of example, with reference to the accompanying drawings, wherein:

FIG. 2*a* is a stick-figure representation of a human in a normal walking or standing stance;

FIG. 2*b* is a stick-figure representation of a human in a skier's crouch stance;

FIG. 3 is a cross-section along the line III—III of FIG. 1;

FIG. 4 is a detail of another embodiment of a heel flange adjustment means, in a view similar to that of FIG. 1;

FIG. 5 is a cross-section along the line V—V of FIG. 4;

DETAILED DESCRIPTION OF PREFERRED EXAMPLE EMBODIMENTS AND OF THE BEST MODE OF THE INVENTION

Figure 1:
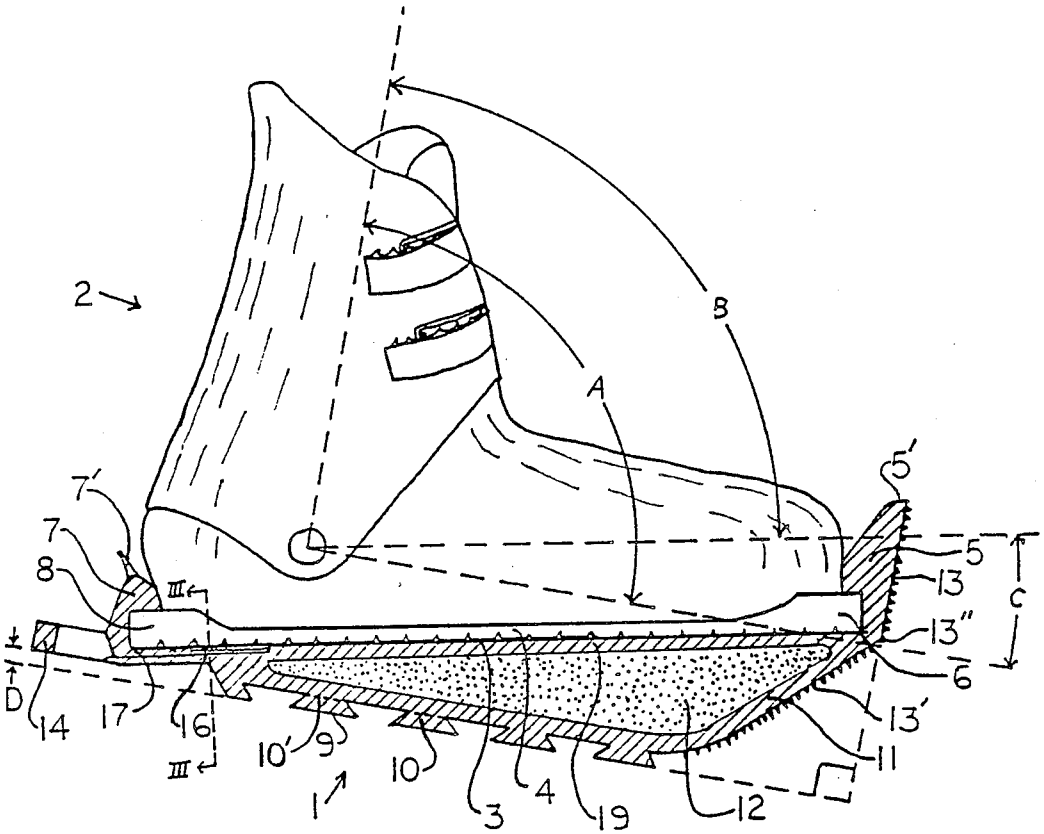
FIG. 1 is a sectional side view of the oversole of the invention attached to a standard ski boot shown in a schematic side view.

As shown in FIG. 1, the oversole 1 according to the invention is snugly attached to a standard, modern ski boot 2, or any similar boot. The oversole 1 includes a sole contact surface 3 of a sole plate 19, which surfacially contacts and extends across the surface of a sole 4 of the boot 2. The front end of the sole contact surface 3 is bounded by a toe engagement cup or flange 5, which only engages a standard-sized toe lip 6 of the boot 2. The rear end of the sole contact surface 3 is bounded by a heel engagement cup or flange 7, which snuggly engages a standard-sized heel lip 8 of the boot 2. The flange 7 may be biased toward the heel lip 8 by one or more tension springs 16 (also see FIG. 3), or by other tension means such as narrow bands of an elastomeric polymer. The flange 7 includes a grip tab 7' for easily grasping the flange 7 for attaching the oversole 1 to the boot 2. Similarly, the toe engagement flange 5 includes a grip tab or rim 5'. Before skiing, the oversole 1 is removed from the sole 4, and the toe lip 6 and heel lip 8 of the ski boot 2 are engaged with a modern ski binding for attaching the boot 2 directly to a ski.

As further shown in FIG. 1, the bottom of the oversole 1 is defined by a ground contact surface 9 preferably having a coarse patterned tread 10. The tread 10 may be formed of continuous ridges extending across the width of the ground contact surface 9 as shown here, or alternatively extending along the length of the ground contact surface 9. The ridges of the tread 10 may be continuous, or may comprise separate segments or tread blocks as indicated by the dashed line 10' in FIG. 1. The ground contact surface 9 has essentially the same width as, but is shorter than, the boot sole 4. The ground contact surface 9 extends at an angle, essentially equal to angle C, relative to the sole contact surface 3, so as to form a wedge which is thicker toward the front or toe of the oversole 1 and tapers toward the rear or heel of the oversole 1. The angle C is given by the difference between angle A and angle B, where angle A is the natural angle between the ground and a standing human's lower leg, and angle B is the angle between the ground and a crouching skier's lower leg, as further shown in FIG. 2. Angle B is fixed by the rigid ski boot, and is normally between 85 and 75 degrees, but may be as sharp as 60 degrees for racing ski boots. Angle A is the natural comfortable angle, which is approximately 90 degrees for a standing human, but varies during a walking stride. Angle C is therefore generally between 5 and 15 degrees. It is quite difficult to stand for any length of time while maintaining the leg angle B, because the body's weight is supported primarily by the muscles of the thighs, rather than being statically transmitted through the bones and joints.

The wedge shape of the oversole 1 at least partially compensates for the unnatural angle B which is rigidly enforced by the ski boot 2, so as to achieve the more comfortable standing or walking leg angle A. The oversole 1 may comprise a tough plastic outer skin or layer 11 of polyurethane or nylon, for example, and a resilient inner core 12 of polyurethane foam, for example. The inner core 12 may instead be a hollow air cavity enclosed by the tough outer layer 11. The resilient core 12 allows the angle between the ground contact surface 9 and the sole contact surface 3 to change during a walking stride as the wedge-shape of the oversole 1 becomes compressed, so that the natural variation of angle A during a walking stride may be simulated.

The coarse tread 10 provides good traction, relative to the minimal tread of the boot sole 4, for walking on snow and ice. The shortened length of the ground contact surface 9 relative to the boot sole 4 allows more natural and comfortable rocking or rolling of the foot through a stride during walking. The front or thicker end of the wedge of the oversole 1 may be somewhat rounded, as shown, in order to further improve the walking characteristics. Through these measures, the comfort and ease of walking in ski boots is greatly improved.

As further shown in FIG. 1, the front end of the oversole 1 includes an essentially flat base 13 for storing the boots as described below with reference to FIGS. 6, 7, and 8. The base 13 may be, but is not necessarily, an integral component of the toe engagement flange 5. The base 13 extends essentially perpendicularly relative to the plane of the ground contact surface 9, as indicated in FIG. 1. Preferably, the rear end of the oversole 1 includes a handle 14 for carrying the boots. The handle 14 may be, but is not necessarily, an integral component of the heel engagement flange 7. The handle 14 is preferably an extension of side flanges 15 (FIG. 3), which extend along the lateral edges of the sole contact surface 3 and contact or engage the edges of the ski boot sole 4.

The storage base 13 and the handle 14 are located at a sufficient distance D from the plane of the ground contact surface 9, so that they do not interfere with normal walking, but may provide additional support or traction when the wearer is walking in deep snow or climbing steep grades. Therefore, the base 13 preferably comprises at least a ribbed or grooved tread 13', and an edge 13'', which may be "chiseled" into an inclined ice or snow surface for climbing a steep grade. The tread 13' extends across the entire storage base 13, and toward the ground contact surface 9, until meeting the coarse tread 10.

FIG. 3 is a cross-section along the line III—III of of FIG. 1. In order to allow size adjustment for accommodating ski boots with different length soles, the heel engaging cup or flange 7 includes a widened slider plate 17, which slides longitudinally along a groove or track 18 let into the side flanges 15 of the oversole 1. The sole of the heel of a ski boot (not shown) rests on the top surface of the slider plate 17, while the heel cup or flange 7 is urged into tensioned engagement with the heel lip of the ski boot by means of tension springs 16 attached, at one end, to the slider plate 17 and, at the other end, to the body of the sole plate 19, as shown more clearly in FIG. 1. The tab 7' may be grasped to pull the flange 7 away from the ski boot heel, in order to attach or detach the over sole 1 from the ski boot. The handle 14 is an extension of the side flanges 15. The springs 16 may be replaced by other tension means such as elastomeric bands, and the placement of these tension means may also vary. For example, slider means and tension means may be provided only within tracks in the side flanges 15, rather than extending across the width of the heel flange 7.

An alternative embodiment of the size adjustment arrangement is shown in FIG. 4. The rest of the oversole 1 may be the same as shown in FIG. 1. The heel engagement flange 7 comprises the slider plate 17, which slides longitudinally in the slider track 18. In this alternative embodiment, the slider plate 17 comprises several adjustment holes 20 passing essentially perpendicularly to the sliding direction through the width of the plate 17 and spaced from one another in the sliding direction. An adjustment locking pin 21 passes through a selected one of the adjustment holes 20.

As further shown in FIG. 5, the adjustment locking pin 21 passes through a single adjustment fixing hole 23 provided in the side flanges 15. The slider plate 17 is adjusted until one of the adjustment holes 20 aligns with the fixing hole 23 so that the locking pin 21 may be passed through the aligned holes. One end of the pin 21 comprises an enlarged knob 22 which may easily be grasped. The opposite end of the pin comprises a circumferential groove or neck 25, which engages a constricted circular bead or collar 24 provided in the fixing hole 23 ass it passes through one of the side flanges 15. Thereby the pin 21 is held securely, and the slider plate 17 with its heel engagement flange 7 is held by the pin 21 in an adjusted position.

In this embodiment of FIGS. 4 and 5, the material of the heel engagement flange 7 (and/or the toe engagement flange 5) is somewhat elastic or resilient so that the respective flange 7, 5 may be deflected or temporarily bent to allow the ski boot 2 to be inserted between the flanges 7, 5. The slider plate 17 is first adjusted as described above, so that after the boot is inserted, the flanges 7, 5 resiliently return to their original shape to firmly engage the lips 8, 6 of the boot.

Figure 6:
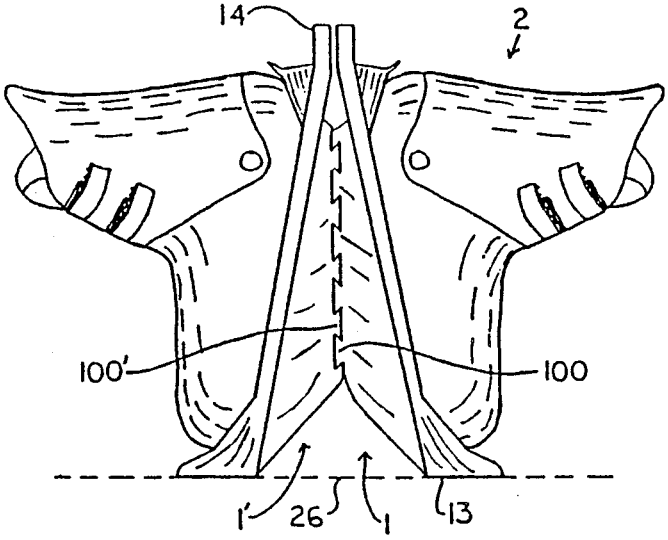
FIG. 6 is a schematic side view of a pair of boots interlocked for storage or carrying by means of a dovetail mating pair of oversoles according to the invention.

FIG. 6 shows a mating pair of oversoles 1 and 1' interlocked according to the invention, for carrying or storing a pair of ski boots. Each ski boot 2 is first attached to its respective oversole 1, 1' as described above. The oversoles 1 and 1' may be fixed together to form a carrier in a sole-to-sole orientation by interlocking the preferred dovetail-type tongue and groove members 100 for preventing movement of the boots of a pair relative to each other in at least four directions out of the six possible linear movement directions in space and 100'. As shown, these tongue and groove members of the oversoles 1 and 1' are mirror images of one another to form an interlocking dovetail joint and relative movement arresting means tongue and groove members 100, 100' may be crosswise dovetail grooves as shown here, or lengthwise dovetail grooves, or even dovetail blocks or segments, for example as indicated by the dashed line 10' in FIG. 1. Due to the above mentioned movement preventing the two boots shown in FIG. 6 cannot move up and down relative to each other and they cannot be moved away from each other horizontally, whereby the dovetail tongues and grooves perform an interlocking function and an arresting function when the present combination serves as a carrier not requiring any other connecting means between the two oversoles of a pair. The tongues and grooves also function as slip resistance.

When the boots and oversoles are interlocked in this manner, the rigid unit may be conveniently carried by the handles 14, or stored by standing the flat coplanar bases 13 on the ground 26 or by hanging the handles 14 from a hook or loop. The oversoles 1 1' may be easily separated for walking in the boots, and then removed from the boots for skiing.

Figure 7:
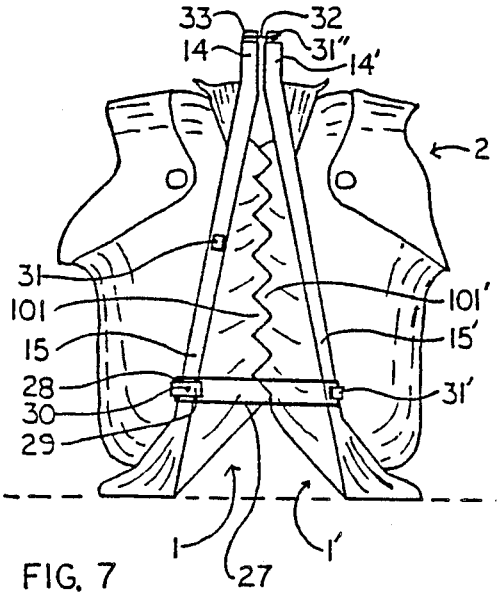
FIG. 7 is a view similar to that of FIG. 6, but with alternative means for interlocking the oversoles.

FIG. 7 shows another embodiment of interlocking means. Here, the treads are not dovetail treads but simple intermeshing serrated tongue and groove treads 101, 101' of triangular ridges and grooves, or any treads which intermesh to prevent parallel movements in two opposite directions without interlocking against movement in other directions. A wire bail 27 is hinged at 28 to a swivel-hinge block 29 which is attached by a swivel 30 to the side flange 15 of the oversole 1. One or more of such wire bail combinations may be provided on each side flange. A bail catch or hook 31' is provided on the side flange 15' of the other oversole 1' for engaging the wire bail 27 in the interlocked position as shown. A similar bail hook 31 is provided on the side flange 15 of the oversole 1 for engaging the wire bail 27 in a position during walking. A shorter wire bail 32 is hinged at a hinge block 33 of the handle 14, and a bail hook 31'' is provided on the handle 14' to engage the bail 32 in the interlocked position. These wire bails arrest the two oversoles against movement horizontally away from each other in FIG. 7.

Figure 8:
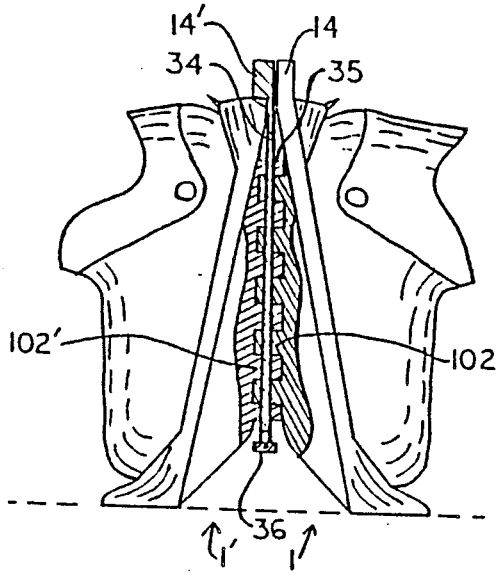
FIG. 8 is a view similar to that of FIG. 6, but in partial section and showing a further embodiment of interlocking locking means.

FIG. 8 shows a further embodiment of interlocking means. The treads 102, 102' of the oversoles 1, 1' are simple intermeshing treads, such as treads made up of square ridges or tongues and grooves. Interlocking of the treads is achieved by passing one or more interlocking rods 34 through appropriate holes 35 in the treads. The holes 35 pass through all of the ridges or the treads 102, 102' Thereby, the rod 34 passes through both of the treads 102 and 102' so as to interconnect them so that the soles of a pair ar arrested against horizontally moving away from each other in FIG. 8. In the case of crosswise treads as shown, the rod or rods 34 extend through lengthwise hole or holes 35. In this embodiment, the rod or rods 34 may advantageously be combined with the handle 14'. While the handle 14 remains rigidly connected to the oversole 1 for carrying the interlocked boots, the handle 14' serves as a handle attached to one end of the interlocking rod or rods 34 The other end of each rod 34 is provided with a tiltable T-catch 36 or similar means which may be adjusted selectively to pass through the hole 35 or to fix the rod 34 in the inserted position. As an alternative to this specific embodiment, crosswise rods may pass through lengthwise extending treads.

While the boot oversole and carrier of the invention has been described with reference to specific example embodiments, these embodiments should not be construed as a limitation, as the invention applies to any other embodiments within the scope of the appended claims. For example, the invention is also intended to cover the application or adaptation of the oversole for use with other footwear, such as mountain climbing boots, ice skates, roller skates, etc. Each of these applications would entail specific advantages, but generally would still achieve the objects of this invention listed above.

Although the invention has been described with reference to specific example embodiments, it is to be appreciated that it is intended to cover all modifications and equivalents within the scope of the appended claims.

What I claim is:

1. A boot oversole and carrier combination for attachment to a pair of boots, comprising a first oversole and a second oversole, each oversole comprising a sole contact surface for contacting a boot sole when said oversole is attached to a boot, heel engagement means for engaging a heel of said boot sole at a rear end of said oversole, toe engagement means for engaging a toe of said boot sole at a front end of said oversole, a ground contact surface approximately opposite said sole contact surface, and interlocking means for interlocking said first and second oversoles with each other to form a mating pair of oversoles, said interlocking means comprising tongue and groove means in each ground contact surface of said first and second oversoles for interlocking said first and second oversoles with each other against parallel movement relative to each other in at least two opposite directions, and arresting means or preventing said tongue and groove means to move away from each other in opposite directions when said combination functions as a carrier, said tongue and groove means operating to provide a slip resistance when said combination functions as boot oversoles.

2. The boot oversole and carrier combination of claim 1, wherein each of said first and second oversoles comprises a boot storage base having a stand-up surface extending essentially perpendicularly relative to said ground contact surfaces.

3. The boot oversole and carrier combination of claim 2, wherein said storage base is arranged at said front end of said oversole.

4. The boot oversole and carrier combination of claim 3, wherein said storage base and said toe engagement means are a single integral component permitting to stand a pair of boots on a surface with boot tips facing downwardly.

5. The boot oversole and carrier combination of claim 1, further comprising handle means arranged at a certain clearance distance away from the plane of said ground contact surface.

6. The boot oversole and carrier combination of claim 5, wherein said handle and said heel engagement means form a single integral component.

7. The boot oversole and carrier combination of claim 1, wherein said toe engagement means comprise a toe engagement flange for engaging a standard-sized boot toe lip of said boot, and said heel engagement means comprise a heel engagement flange for engaging a standard-sized boot heel lip of said boot.

8. The boot oversole and carrier combination of claim 7, wherein at least one of said toe engagement flange and said heel engagement flange is made of a flexible elastic material to allow said flange to be elastically deformed for causing a respective engagement of said boot toe lip or said boot heel lip.

9. The boot oversole and carrier combination of claim 7, wherein at least one of said toe engagement flange and said heel engagement flange further comprises adjustment means for accommodating different sizes of said pair of boot.

10. The boot oversole and carrier combination of claim 11, wherein said adjustment means comprise a slider plate carrying said engagement flange, a slide track comprising side flanges in which said slider plate slides in essentially a lengthwise direction of said oversole, and tension means for urging said slider plate carrying said engagement flange into engagement with said boot lip.

11. The boot oversole and carrier combination of claim 12, wherein said tension means comprise several adjustment holes bored through said slider plate in a direction essentially perpendicular to its sliding direction, at least one fixing hole bored through said side flanges in a direction parallel to that of said adjustment holes, and an adjustment fixing pin removably inserted through said fixing hole and a coaxially aligned one of said adjustment holes.

12. The boot oversole and carrier combination of claim 1, wherein said oversole comprises a wedge shape formed between said sole contact surface and said ground contact surface, whereby said wedge is thicker at said front end and thinner at said rear end.

13. The boot oversole and carrier combination of claim 1, wherein said oversole comprises a double wedge shape having a shorter forwardly tapering wedge section and a longer rearwardly tapering wedge section.

14. The boot oversole and carrier combination of claim 1, wherein said tongue and groove means and said arresting means are realized by dovetail grooves and dovetail tongues.

15. The boot oversole and carrier combination of claim 17, wherein said dovetail grooves and tongues comprise non-continuous dovetail blocks.

16. The boot oversole and carrier combination of claim 1, wherein said arresting means comprise bail means hinged to a perimeter of said first oversole of said mating pair of oversoles and corresponding catch hook means for receiving said bail means operatively arranged on a perimeter of said second oversole of said mating pair of oversoles for arresting said first and second oversoles against movement away from each other.

17. The boot oversole and carrier combination of claim 1, wherein said ground contact surface comprises coarse treads forming said interlocking tongue and groove means, and wherein said arresting means comprise at least one aligned interlocking hole bored through said coarse treads, and correspondingly at least one interlocking rod insertable in said aligned interlocking hole, whereby said coarse treads of said first oversole of said mating pair of oversoles mesh with said coarse treads of said second oversole of said mating pair of oversoles so that said aligned interlocking holes of both oversoles align coaxially for arresting said first and second oversoles against movement away from each other.

* * * * *

UNITED STATES PATENT AND TRADEMARK OFFICE

CERTIFICATE OF CORRECTION

PATENT NO. : 4,843,672

DATED : July 4, 1989

INVENTOR(S) : Walter F. Fasse

It is certified that error appears in the above-identified patent and that said Letters Patent is hereby corrected as shown below:

Claim 1, (Col. 8, line 5), replace "or" by --for--.

Claim 9, (Col. 8, line 46), replace "boot" by --boots--.

Claim 10, (Col. 8, line 48), replace "11" by --9--.

Claim 11, (Col. 8, line 55), replace "12" by --10--.

Claim 15, (Col. 9, line 11), replace "17" by --14--.

Signed and Sealed this

Thirteenth Day of March, 1990

*Attest:*

JEFFREY M. SAMUELS

*Attesting Officer*

*Acting Commissioner of Patents and Trademarks*